United States Patent [19]

Asahi

[11] Patent Number: 4,460,812

[45] Date of Patent: Jul. 17, 1984

[54] PNEUMATICALLY OPERATED SWITCH ASSEMBLY

[75] Inventor: Kiyonobu Asahi, Anjo, Japan

[73] Assignee: Aisin Seiki Kabushiki Kaisha, Kariya, Japan

[21] Appl. No.: 355,306

[22] Filed: Mar. 5, 1982

[30] Foreign Application Priority Data

Mar. 11, 1981 [JP] Japan ..... 56-35678

[51] Int. Cl.[3] ..... H01H 35/24

[52] U.S. Cl. ..... 200/83 J; 200/34

[58] Field of Search ..... 200/34, 83 Q, 83 J, 200/81 H

[56] References Cited

U.S. PATENT DOCUMENTS

| | | | |
|---|---|---|---|
| 2,996,155 | 8/1961 | Priesemuth | 200/34 X |
| 3,236,961 | 2/1966 | Kappel | 200/34 |
| 3,246,094 | 4/1966 | Zaske et al. | 200/34 X |
| 3,639,711 | 2/1972 | Jordan et al. | 200/34 X |

*Primary Examiner*—J. R. Scott

*Attorney, Agent, or Firm*—Oblon, Fisher, Spivak, McClelland & Maier

[57] ABSTRACT

A pneumatically operated switch assembly for controlling an electric current supply to an electric control system in addordance with a value of such a signal pressure as a negative or positive pressure, which comprises a spring-loaded diaphragm piston assembled within a housing to form a first chamber for connection to the signal pressure and a second closed chamber and being arranged to move to and away from its assembled position in accordance with a difference in pressure between the chambers, a check valve assembled with the diaphragm piston to allow the flow of air from the first chamber to the second chamber, an orifice member assembled with the diaphragm piston in parallel with the check valve to throttle the flow of air passing therethrough, and a switch assembly arranged within the housing to control the electric current supply in accordance with movement of the diaphragm piston.

5 Claims, 1 Drawing Figure

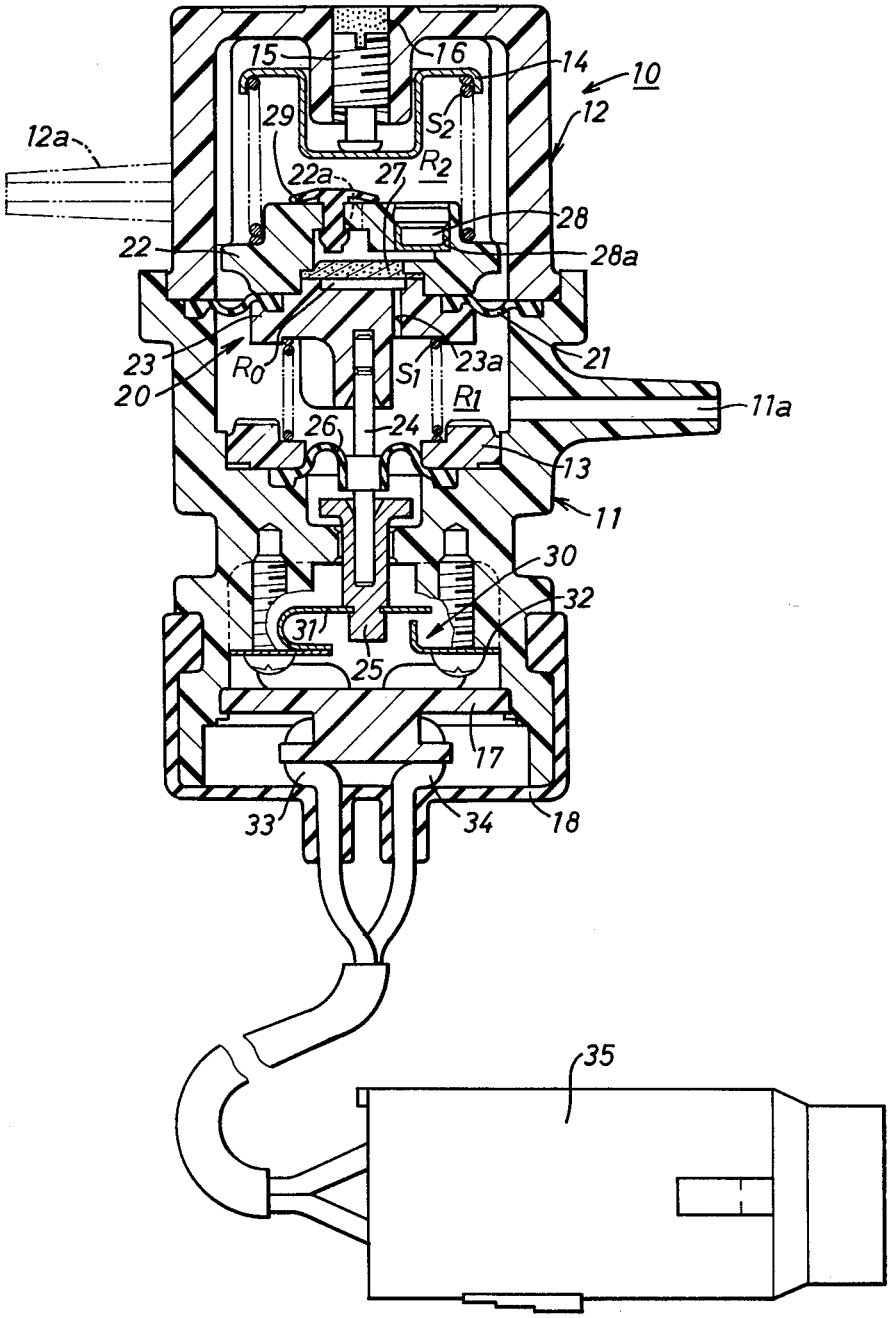
15
16
14
10
12
12a
29
S2
R2
22a
27
28
22
28a
23
R0
S1
23a
21
20
R1
11a
26
24
13
11
30
32
31
25
17
33
34
18
35

PNEUMATICALLY OPERATED SWITCH ASSEMBLY

BACKGROUND OF THE INVENTION

The present invention relates to a pneumatically operated switch assembly for controlling an electric current supply to an electric control system in accordance with a value of such a signal pressure as a negative or positive pressure.

SUMMARY OF THE INVENTION

The primary object of the present invention is to provide a novel pneumatically operated switch assembly, for example, suitable for an electric air-fuel mixture ratio control system for an internal combustion engine in which an electrically operated air change-over valve is operated under control of an electric current supply thereto through the switch assembly to control the quantity of air supply to an intake pipe of the engine in accordance with a negative pressure appearing in the intake pipe.

Accordingly, the present invention is directed to provide a pneumatically operated switch assembly for controlling an electric current supply to an electric control system in accordance with a value of such a signal pressure as a negative or positive pressure, which comprises a housing provided with an inlet port for connection to a source of the signal pressure, a spring-loaded diaphragm piston assembled within the housing to form a first chamber in open communication with the inlet port and a second closed chamber, the diaphragm piston being arranged to move to and away from its assembled position in accordance with a difference in pressure between the two chambers, a check valve means disposed between the two chambers for allowing the flow of air from the first chamber to the second chamber when the pressure in the first chamber exceeds a predetermined value in relation to the pressure in the second chamber; a flow restriction means disposed in parallel with the check valve means between the two chambers for throttling the flow of air passing therethrough, and a switch assembly including movable and fixed contact members assembled within the housing, the movable contact member being interconnected with the diaphragm piston to engage or disengage from the fixed contact member in response to movement of the diaphragm piston.

BRIEF DESCRIPTION OF THE DRAWING

The above and other objects, features and advantages of the present invention will become more readily apparent from the following description of a preferred embodiment with reference to the accompanying drawing, in which the single FIGURE is a view of elevational cross-section of a pneumatically operated switch assembly according to the present invention.

DESCRIPTION OF THE PREFERRED EMBODIMENT

The single FIGURE illustrates a pneumatically operated switch assembly 10 in accordance with the present invention adapted to an electric air-fuel mixture ratio control system for an internal combustion engine in which an electrically operated air change-over valve (not shown) is operated under control of an electric current supply thereto through the switch assembly 10 to control the quantity of air supply to an intake pipe of the engine in accordance with a value of negative pressure appearing in the intake pipe. The pneumatically operated switch assembly 10 has a housing assembly which includes a main housing body 11 provided with an inlet port 11*a* for connection to a negative pressure port (not shown) in the intake pipe and an upper housing body 12 hermetically coupled with the upper end of main housing body 11. Assembled within the housing assembly are a diaphragm piston 20 and a normally open switch assembly 30 arranged to be closed in response to downward movement of the diaphragm piston 20.

The diaphragm piston 20 includes a first diaphragm 21 of large diameter of which the outer periphery is clamped between the housing bodies 11 and 12 to form first and second chambers $R_1$ and $R_2$, the first chamber $R_1$ being in open communication with the inlet port 11*a*. The first diaphragm 21 is clamped at its inner periphery by a holder 22 and a retainer 23 which are hermetically coupled to each other. The diaphragm piston 20 further includes a rod 24 which is fixedly connected at its one end to the center of retainer 23 and at its other end to a receiver 25. A second diaphragm 26 of small diameter is clamped at its outer periphery between an annular stepped portion of housing body 11 and an annular stopper 13 and is fixed at its center to an intermediate portion of rod 24 to hermetically close the first chamber $R_1$. Interposed between the stopper 13 and the retainer 23 is a coil spring $S_1$ which acts to bias the diaphragm piston 20 upwardly, and interposed between the holder 22 and an upper retainer 14 is a coil spring $S_2$ which acts to bias the diaphragm piston 20 downwardly against the load of spring $S_1$. The upper retainer 14 is supported by an adjusting screw 15 which is adjustably threaded into the upper wall of housing body 12 and closed by silicon rubber 16. Thus, the diaphragm piston 20 is held in its assembled position due to balance of the loads of both coil springs $S_1$ and $S_2$.

In such arrangement as described above, an air filter element 27 is assembled within a space $R_0$ which is formed between the holder 22 and the retainer 23. The holder 22 is provided with a stepped through hole 28*a* in which a cup-shaped metallic orifice member 28 is fixedly assembled to provide a flow restriction means between the space $R_0$ and the second chamber $R_2$. The holder 22 is further provided with an opening 22*a* which is arranged in parallel with the stepped through hole 28*a* and is normally closed by a check valve body 29 of synthetic rubber. The retainer 23 is also provided with a through hole 23*a* for communication between the first chamber $R_1$ and the space $R_0$. The metallic orifice member 28 is formed at its center with an orifice which acts to throttle the flow of air passing therethrough. The check valve body 29 is fixed at its neck portion to the holder 22 and acts as a check valve means to allow the flow of air into the second chamber $R_2$ from the first chamber $R_1$ through space $R_0$ and opening 22*a* when the pressure in the first chamber $R_1$ exceeds a predetermined value in relation to the pressure in the second chamber $R_2$.

The normally open switch assembly 30 includes a movable contact 31 in the form of a leaf spring member and a fixed contact 32 in the form of a terminal plate. The leaf spring member 31 and the terminal plate 32 are fixed in place by respective screws threaded into an annular stepped portion of housing body 11, which are connected to lead wires 33, 34 respectively. The leaf spring member 31 is connected at its movable portion to the receiver 25 and opposed at its free end to the upper end of terminal plate 32 to provide a normally open switch. The lead wires 33, 34 extend outwardly through a bottom plate 17 and a cover member 18 of synthetic rubber and are connected to a connector plug 35 which is arranged to be connected to the electrically operated air changeover valve. The bottom plate 17 is fixed at its outer periphery to the inner wall of housing body 11, and the cover member 18 is coupled over the bottom portion of housing body 11 to prevent entry of dust and moisture into the housing assembly.

In operation, when the first chamber $R_1$ is supplied through inlet port 11*a* with a negative pressure at a level higher than a predetermined value, the diaphragm piston 20 moved downwardly by a difference in pressure between the first and second chambers $R_1$ and $R_2$ against the biasing force of coil spring $S_1$, and in turn, the movable contact 31 engages the fixed contact 32 to supply an electric current to the electrically operated air change-over valve (not shown). In this instance, the flow restriction means 28 acts to throttle the flow of air from the second chamber $R_2$ to the first chamber $R_1$ so as to gradually apply the negative pressure to the second chamber $R_2$ therethrough. When the difference in pressure between the chambers $R_1$ and $R_2$ decreased with lapse of a period of time, the coil spring $S_1$ acts to return the diaphragm piston 20 upwardly and to disengage the movable contact 31 from the fixed contact 32. This results in disconnection of the electric current to the electrically operated air change-over valve after lapse of the period of time. If the level of applied negative pressure to the first chamber $R_1$ is higher than that in the above operation, the period of time necessary for decreasing the difference in pressure between the first and second chambers $R_1$ and $R_2$ becomes longer in accordance with the level of applied negative pressure.

When the first chamber $R_1$ is applied through inlet port 11*a* with a negative pressure at a low level such as the atmospheric pressure level after the above operation, the check valve means 29 acts to allow the flow of air into the second chamber $R_2$ from the first chamber $R_1$ through opening 22*a* so as to quickly eliminate the difference in pressure between the chambers $R_1$ and $R_2$. If the level of applied negative pressure to the first chamber $R_1$ is lower than the predetermined value at the initial stage of the above operation, the diaphragm piston 20 does not move downwardly against the biasing force of coil spring $S_1$ because of insufficient difference in pressure between the chambers $R_1$ and $R_2$, and the movable contact 31 may not be engaged with the fixed contact 32.

From the above description, it will be understood that the period of time for supplying an electric current to the electrically operated air change-over valve is controlled in accordance with the level of negative pressure applied as a signal pressure to the first chamber $R_1$ through inlet port 11*a*. In actual practice, the pneumatically operated switch assembly may be adapted to other various electric control systems, and the switch assembly 30 may be modified to be a normally closed switch assembly if necessity. Alternatively, the inlet port 11*a* may be replaced with an inlet port 12*a* indicated by imaginary lines in the figure, which inlet port 12*a* is provided on the upper housing body 12 to apply a positive pressure to the second chamber $R_2$. In addition, the flow restriction means 28 and the check valve means 29 may be provided within bypass passage means for communication between the first and second chambers $R_1$ and $R_2$ outside the housing assembly.

Having now fully set forth both structure and operation of a preferred embodiment of the concept underlying the present invention, various other embodiments as well as certain variations and modifications of the embodiment herein shown and described will obviously occur to those skilled in the art upon becoming familiar with said underlying concept. It is to be understood, therefore, that within the scope of the appended claims the invention may be practiced otherwise than as specifically set forth herein.

What is claimed as new and desired to be secured by Letters Patent of the United States is:

1. A pneumatically operated switch assembly for controlling an electric current supply to an electric control system in accordance with a level of negative pressure applied thereto, comprising:

a housing provided with an inlet port for connection to a source of said negative pressure;

a diaphragm piston assembly mounted in said housing to subdivide the interior of said housing into first and second closed chambers, said first chamber being in open communication with said inlet port, and said diaphragm piston assembly being arranged to move to and away from a balanced position in accordance with a difference in pressure between said first and second chambers;

resilient means for biasing said diaphragm piston assembly toward said second chamber;

check valve means mounted on said diaphragm piston assembly to allow only the flow of air from said first chamber to said second chamber when said negative pressure at the source exceeds a predetermined level;

flow restriction means mounted on said diaphragm piston assembly to throttle the flow of air passing therethrough; and switch means of the normally open type including movable and fixed contact members mounted in said housing, said movable contact member being operatively connected with said diaphragm piston assembly to engage said fixed contact member in response to movement of said diaphragm piston assembly against the biasing of said resilient means and to disengage from said fixed contact member in response to movement of said diaphragm piston assembly under the biasing of said resilient means.

2. A pneumatically operated switch assembly as claimed in claim 1, further comprising additional resilient means for biasing said diaphragm piston assembly toward said first chamber so as to maintain said diaphragm piston assembly in said balanced position.

3. A pneumatically operated switch assembly as claimed in claim 1, wherein said diaphragm piston assembly comprises a first diaphragm of large diameter mounted in said housing to separate said first and second chambers; a second diaphragm of smaller diameter mounted in said housing to isolate said switch means from said first chamber in a fluid-tight manner; and a rod connected at one end thereof with said first diaphragm, at an intermediate portion thereof with said second diaphragm, and at another end thereof with said movable contact member of said switch means.

4. A pneumatically operated switch assembly as claimed in claim 3, wherein said movable contact member is in the form of a leaf spring member fixed at one end to an annular stepped portion in said housing, and said fixed contact member is in the form of a terminal plate fixed at one end to said annular stepped portion in said housing and being opposed at another end to another end of said leaf spring member, and wherein said leaf spring member is connected to said other end of said rod.

5. A pneumatically operated switch assembly as claimed in claim 3, wherein said first diaphragm is clamped at its inner periphery by a holder and a retainer which are hermetically coupled to each other, said check valve means and said flow restriction means being mounted in parallel on said holder, and said retainer being provided with a through hole for communicating said first chamber into said second chamber through said check valve means and said flow restriction means.

* * * * *